United States Patent [19]

Biagiotti et al.

[11] Patent Number: 4,921,235

[45] Date of Patent: May 1, 1990

[54] APPARATUS AND METHOD FOR FOLDING AND STACKING NAPKINS FROM A CONTINUOUS WEB OF PAPER OR OTHER MATERIAL

[76] Inventors: Guglielmo Biagiotti, Via Di Vorno 105, 55012 Capannori (Lucca); Mauro Ghilardi, Via di Tiglio 108, Pieve S. Paolo, Capannori (Lucca), both of Italy

[21] Appl. No.: 225,409

[22] Filed: Jul. 28, 1988

[30] Foreign Application Priority Data

Jul. 28, 1987 [IT] Italy ..... 9443 A/87

[51] Int. Cl.[5] ..... B42C 1/04

[52] U.S. Cl. ..... 270/47; 270/21.1; 270/45; 270/48

[58] Field of Search ..... 270/20.1, 21.1, 45, 270/47, 48, 51, 54, 58, 60; 193/360, 418, 442, 450

[56] References Cited

U.S. PATENT DOCUMENTS

| | | | |
|---|---|---|---|
| 3,999,454 | 12/1976 | Tiso | 270/21.1 |
| 4,190,241 | 2/1980 | Krueger | 270/60 |
| 4,344,610 | 8/1982 | Jeschke | 270/21.1 |
| 4,564,470 | 1/1986 | Schmitt | 270/21.1 |
| 4,736,936 | 4/1988 | Hertel | 270/58 |

FOREIGN PATENT DOCUMENTS

| | | | |
|---|---|---|---|
| 220064 | 12/1983 | Japan | 270/40 |
| 861110 | 9/1981 | U.S.S.R. | 493/450 |

*Primary Examiner*—Robert E. Garrett
*Assistant Examiner*—Therese M. Newholm
*Attorney, Agent, or Firm*—Francis J. Bouda

[57] ABSTRACT

A continuous web of paper which may be longitudinally folded in half is drawn around a rotating cylinder which cuts the web into pre-determined suitable lengths. Vacuum and air pressure means temporarily hold the severed portions of the web against the cylinder, but at an appropriate moment release the leading edge of the severed portion causing it to be lifted in its leading half away from the cylinder, the trailing half being retained by suction against the cylinder. The lifted leading edge folds backward against the trailing portion along a fold line, and subsequently the folded-together leading and trailing portions are released from the cylinder, transported away from the cylinder and into a stacking tray, for subsequent packaging. The cut and folded sections of the web are, at all times, held under control by a vacuum in one or more cylinders or conveyor belts until the very last moment when they are discharged into a receiving and stacking tray.

26 Claims, 8 Drawing Sheets

Fig. 7
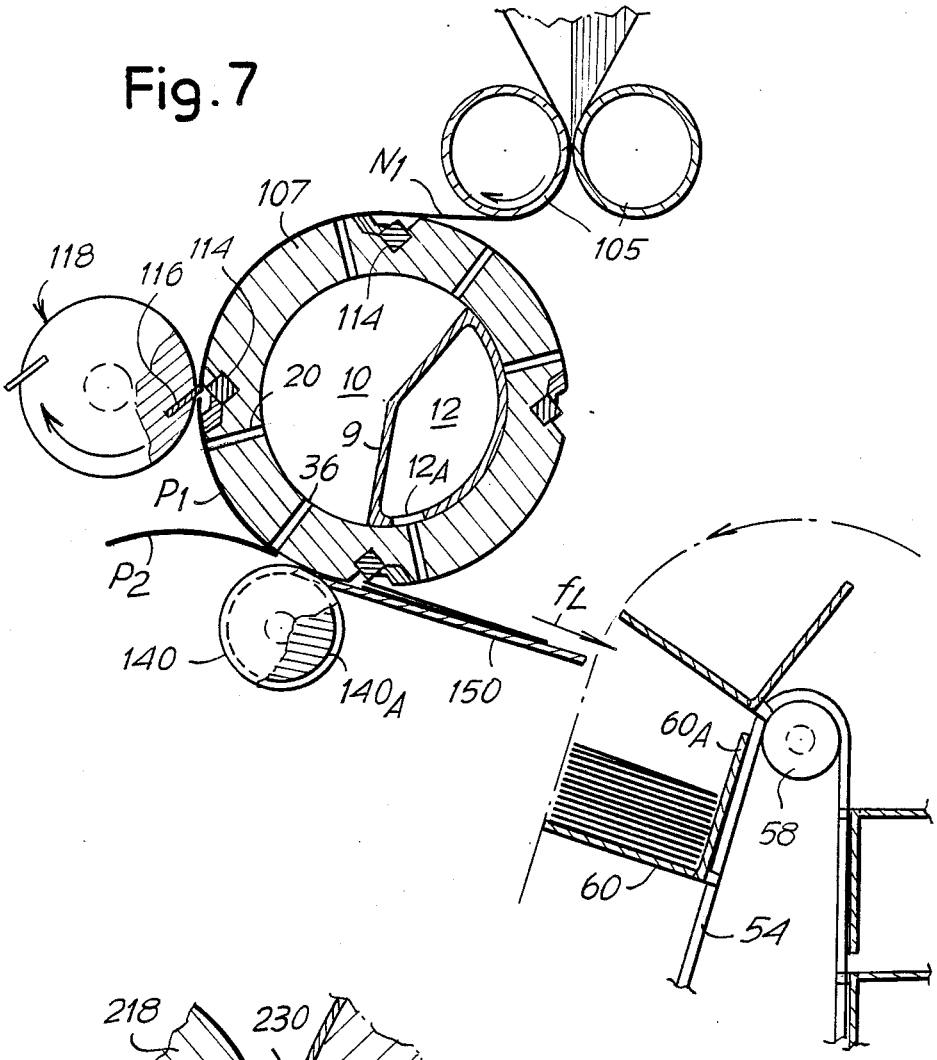
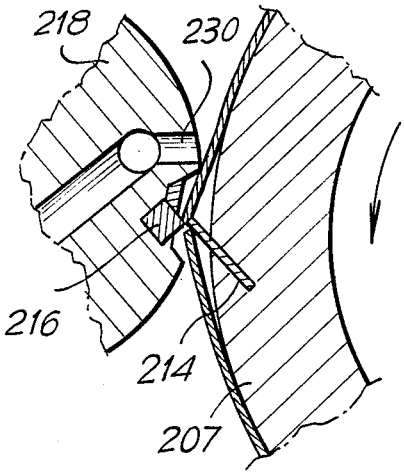
Fig. 8

307
316
312
332
335
N3
334
358
330
380
378
376
356
354
353
C
XII
352
f330
364
f360
360
368
366
374
XII
D
362
364
386
384
382
372
370
350
To
408
410
412
390
402
398
406
398
394
404
400
396
392
To

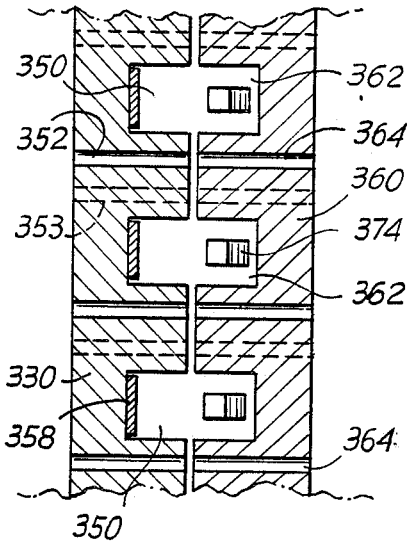
Fig. 12
Fig. 14
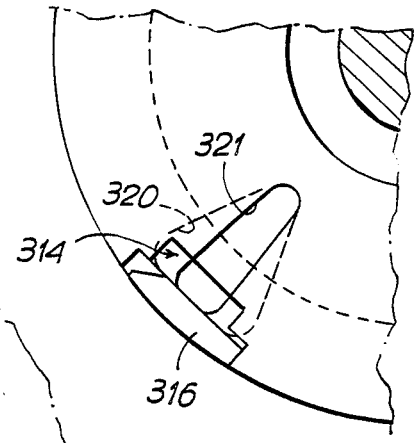
Fig. 13
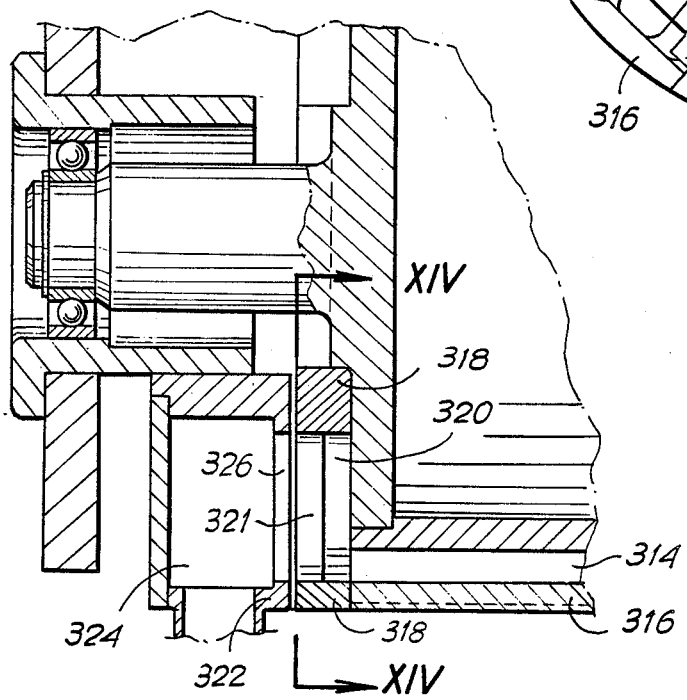

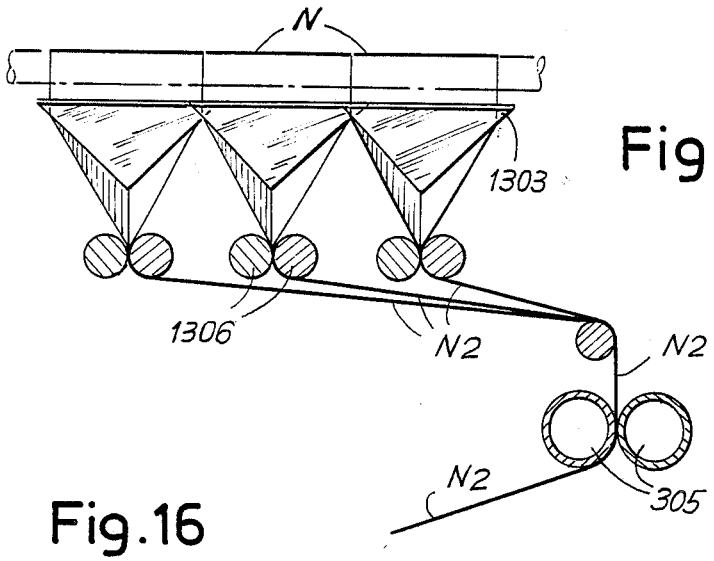
Fig.15
Fig.16
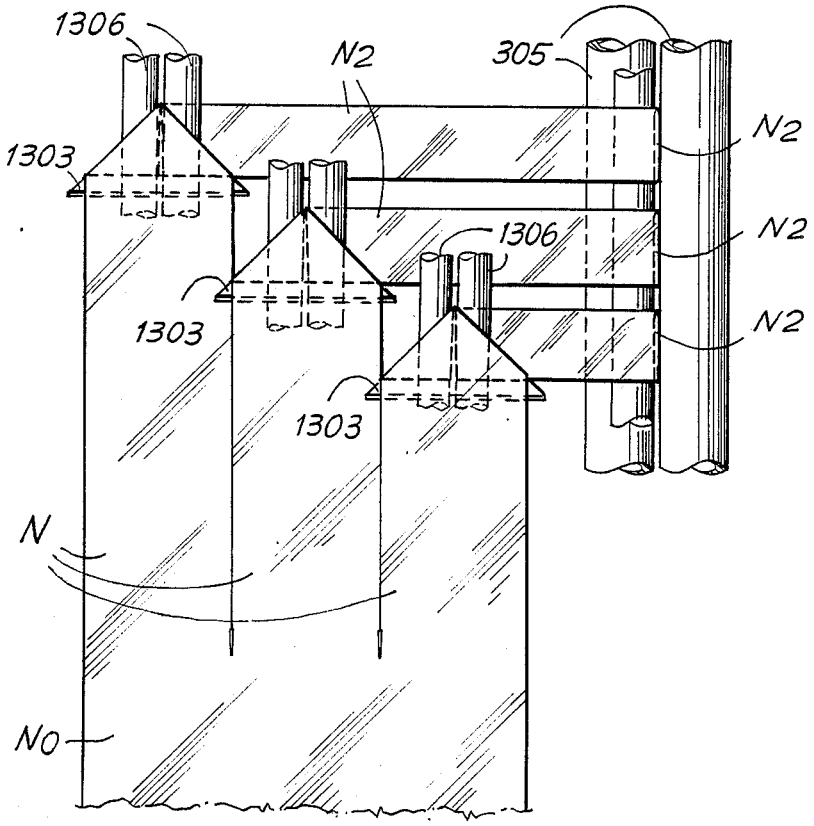

APPARATUS AND METHOD FOR FOLDING AND STACKING NAPKINS FROM A CONTINUOUS WEB OF PAPER OR OTHER MATERIAL

BACKGROUND OF THE INVENTION

It is well known in the art of making, folding, stacking, and packaging paper webs such as table nakins (serviettes), facial tissues and the like, that it is desirable to fold the web longitudinally to create a first "half-fold", and thereafter to fold the web one or more times transversely with regard to the first fold-line to create a "quarter-fold" or "third-fold" or the like, ready for packaging in individual cartons or in bulk-packages for institutional dispensers or the like.

The use of a folding pan to create the first longitudinal fold is well-known, and although included as a first step in this apparatus needs no detailed description.

The subsequent transverse folds to create the one-half or one-third folds is more complicated, and has been the subject of many disclosures such as those shown in various U.S. patents, especially those classified by the U.S. Patent System in Class 270 (Sheet-Material Associating) and particularly Sub-Classes 32 to 51.

The present invention, however, teaches how the transverse folds can be created utilizing the air stream or "air lift" between the leading edge of a paper sheet moved by a rotating cylinder while yet retaining complete control of the sheet against the rotating cylinder.

SUMMARY OF THE INVENTION

In the present invention, a rapidly moving web of lightweight material such as paper or nonwoven sheet is deposited upon the surface of a rotating cylinder. In advance of the deposition, the web may be longitudinally folded across a folding pan to create one or more first longitudinal folds.

As the web carried around the rotating cylinder, it passes between the plurality of cutting elements so disposed around the periphery of this cylinder, as to create webs of desired length, and between such cutting members and opposed cutting element, whereby the web, held by vacuum against the cylinder, is cut into a product of desired length.

Thereafter, the vacuum holding the leading edge of the web against the cylinder is released, and it will lift away from the cylinder, either by centrifugal force, air-pressure assist, or by the inherent "air-lift" between the surfaces of the cylinder and the leading edge as the cylinder rotates.

This causes the leading edge and the frontal portion of the severed section of the web to fold back upon itself to a fold-line which is defined by and held against the cylinder by a suction section.

Continued rotation of the cylinder brings the fold-line portion of the sheet between the cylinder and a conveyor or transfer element, which may be a belt or another cylinder, the suction in the first cylinder in the trailing portion of the severed sheet following the fold-line is released and the folded sheet is conveyed away from the first cylinder into a stacking or packaging receptacle. The stacking or packaging receptacle may include a plurality of trays or similar receiving elements adapted to receive, retain and stack a pre-determined number of folded sheets and subsequently moving on to present another of such receptacles at the discharge portion of the conveyor.

The invention allows the automatic production of folded napkins or serviettes or other folded paper (or similar) articles and the handling thereof, at least for preparing them prior to the packing, or even for operating the latter automatically or through a very limited manual intervention. In this way, high labor costs are avoided.

To accomplish this, the present apparatus produces napkins, or serviettes, or other paper articles, folded one or more times with a continuous feeding of web (which may be folded longitudinally) to a cylinder for moving and transverse cutting. The cylinder includes, in addition to the cutting means and at a distance therefrom, a retaining means and a line where a fold is to be carried out, so as to obtain, through the fast surface speed of the cylinder, a lifting and a backwards turning along said folding line of the paper portion located in advance of said line. A pressing roller acting against said cylinder completes the folding, along with means for interrupting the retention along said folding line after it has passed the folding roller, and means to collect the folded piece and move it away.

The retention means may be of pneumatic or mechanical type, the folding line may be transversal, and the folded piece is moved away by launching it along a trajectory with the fold onwards.

On said cylinder, further retaining means are able to retain by suction the paper portion located at the back of the transversal folding line until the folded piece is moved away.

In the feeding and cutting cylinder means may be provided to blow the leading edge of the sheet away from the cylinder by high pressure inside the cylinder and through the same passage through which the suction for the retention along the folding line and/or in the zone at the back of the folding line has been exerted.

Along the folding line, the suction and retention means may consist of a row of holes able to communicate with a fixed suction cavity, or said suction and retention means may include a channel with holes leading connected to a bank thereof.

In one embodiment, the means for moving the folded piece away from the cutting cylinder and collecting it includes: a rotating pick-up, which is a vacuum cylinder with at least a row of suction holes able to carry the piece into the zone of minimum interspace between the cutting cylinder and the pick-up cylinder, and means for moving away the picked up pieces and piling them up.

The means for moving the picked-up pieces away from the pick-up cylinder and piling them may include circumferential grooves on said pick-up cylinder, separated by projections into which said holes of the vacuum line lead, and comb-like means with prongs inside the grooves for moving away the pieces carried along said pick-up cylinder.

Advantageously, a further cylinder may be provided, being close and similar to the pick-up cylinder, with circumferential grooves and projections with holes along at least a suction line, disposed for alignment with grooves and holes of said pick-up cylinder in the zone of minimum interspace between said cylinders. A shunter that is a sorting means with fingers movable between the circumferential grooves of one and those of the other of said two cylinders may be provided for diverting the pieces arriving into the zone of minimum interspace in order to cause them to continue moving along one or the other of said two cylinders. Means for removing and piling up the pieces are associated with said further cylinder and are similar to those of the pick-up cylinder.

Therefore, one object of the present invention is to provide an apparatus and process for folding, conveying and stacking a flexible web material utilizing the air stream or air lift between a rapidly rotating cylinder surface and the leading edge of the web lying thereon.

A further object of the present invention is to provide a method and apparatus for folding a portion of a paper web carried by a rotating cylinder back upon a trailing portion thereof, and then releasing, conveying and stacking the folded web on a conveyor.

With the above and other objects in view, further information and a better understanding of the present invention may be achieved by referring to the following detailed description:

DETAILED DESCRIPTION

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts:

FIGS. 7 and 8 show two modified embodiments of the web cutters.

FIG. 12 shows a section on line XII—XII of FIG. 11.

FIG. 13 shows a detailed section of an end portion of the cutting cylinder taken along line XIII—XIII, of FIG. 10.

FIG. 14 shows a cross-section along line XIV—XIV of FIG. 13.

FIG. 15 shows, in section, a feeding arrangement formultiple webs, of which FIG. 16 is a partial plan view.

Figure 5:
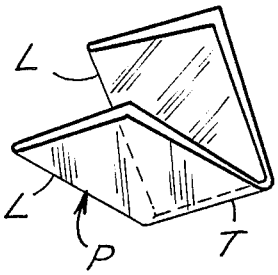
FIGS. 5 and 6 show the steps of quarter-folding a web.
Figure 6:
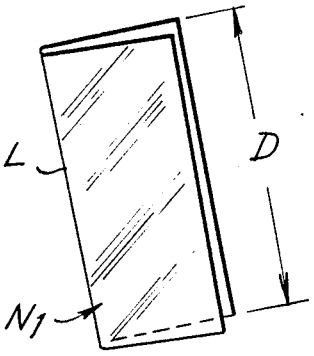
Figure 9:
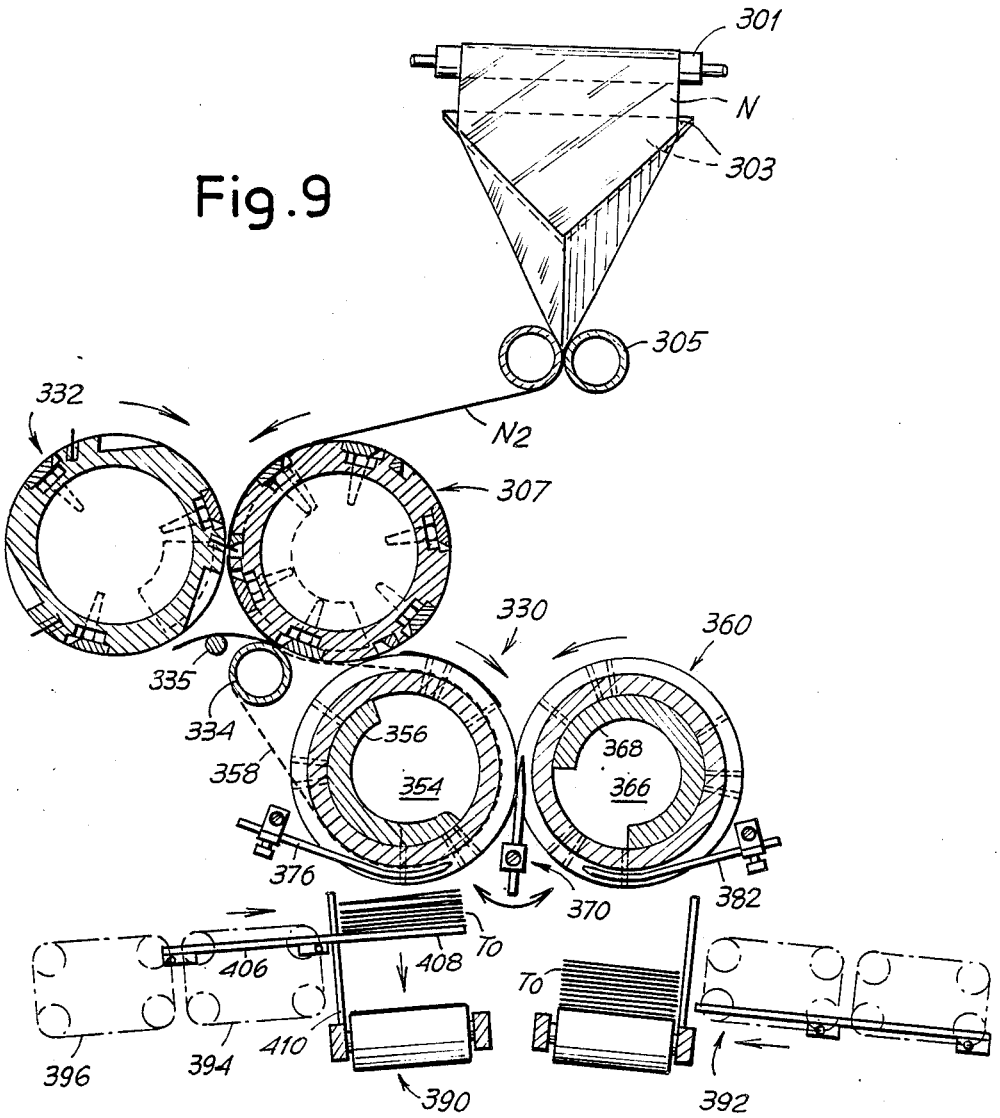
FIG. 9 shows a vertical assembly view in partial section of a further embodiment of the apparatus.
Figure 10:
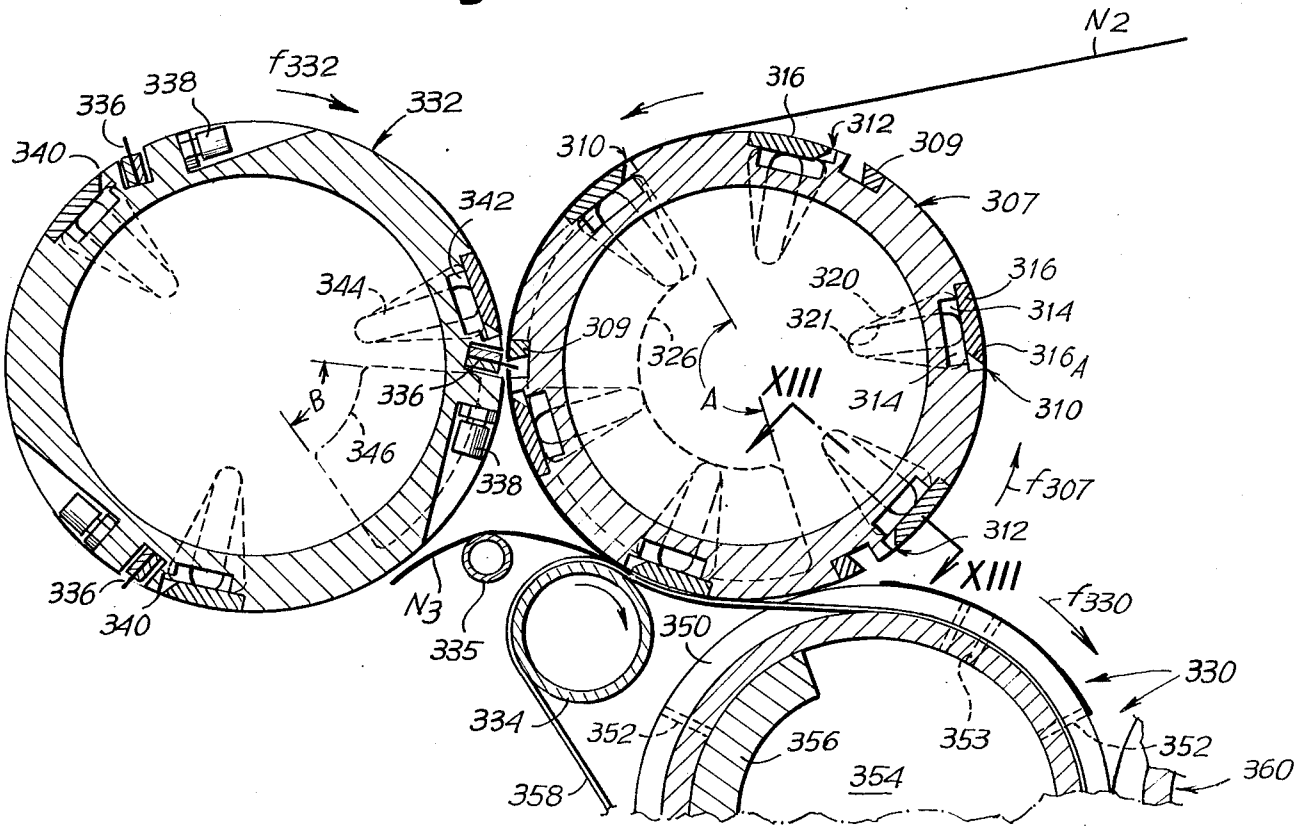
FIGS. 10 and 11 show two enlarged details of FIG. 9.
Figure 11:
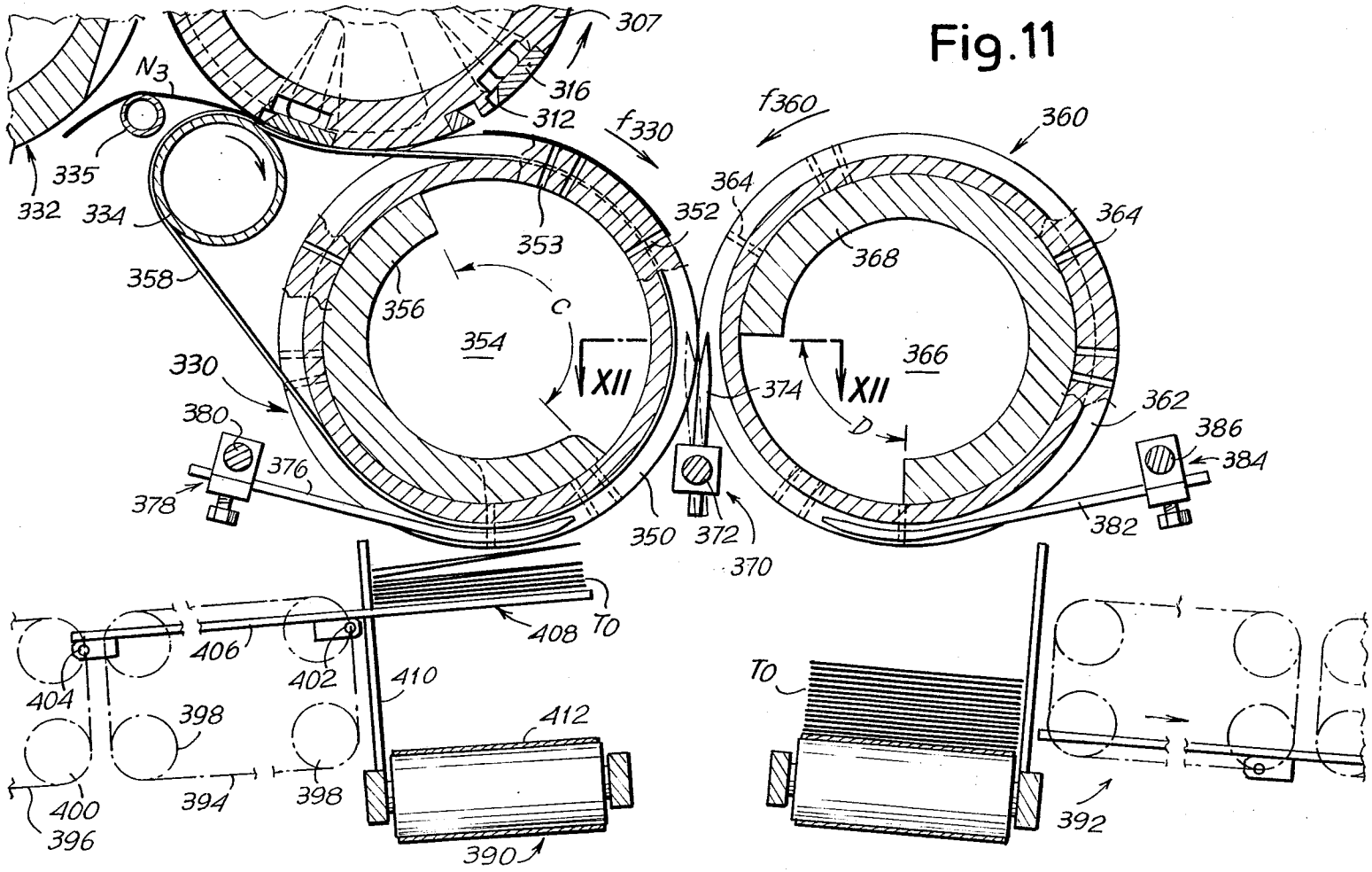

Referring now to FIGS. 1 to 4, numbers 1 and 3 indicate a roller and a folding pan for longitudinally double-folding the paper web N in a continuous way (see N1 in FIG. 6) for preparing the production of serviettes or other pieces to be successively folded at T in a transverse direction (FIG. 5) with respect to the longitudinal folding(s) to which the paper web N (single or double-ply) has been subjected. In the example, a central longitudinal fold L is provided (FIG. 6) and the web N1, double-folded through the longitudinal fold L, moves between the two rollers 5 and is fed, as a folded web N1, to the next working phase.

The web N1 is continuously fed to a rotating transversal cutting cylinder 7. This cylinder is axially hollow and rotates about a fixed structure 9 which defines, together with the cylinder cavity, a vacuum chamber 10 and a chamber 12 where air under slight pressure is present. The cylinder 7 has a circumference developed so as to correspond to a multiple of the length D of the serviette or other article to be produced, as measured in the direction of the web length, that is, of the longitudinal fold L.

In the example, the circumference of the cylinder 7 is four times the length D of each piece to be transversally cut. The web N1, carried around the cylinder 7, is transversally cut by four baldes 14 carried by the same cylinder and spaced apart the dimension D of each piece. Each blade 14 is arranged to cooperate, for the transversal cut of web N1, with a counterblade 16 carried by a unit 18. This unit may be a rotor, turning in the same direction, or in opposition to cylinder 7, and in synchronization therewith, as to ensure the transvesal cut of web N1 at the tangency zone between the blades 14 on cylinder 7 and blades 16 on unit 18. Many known arrangements can be adopted to perform the transversal cut.

Figures 1, 2:
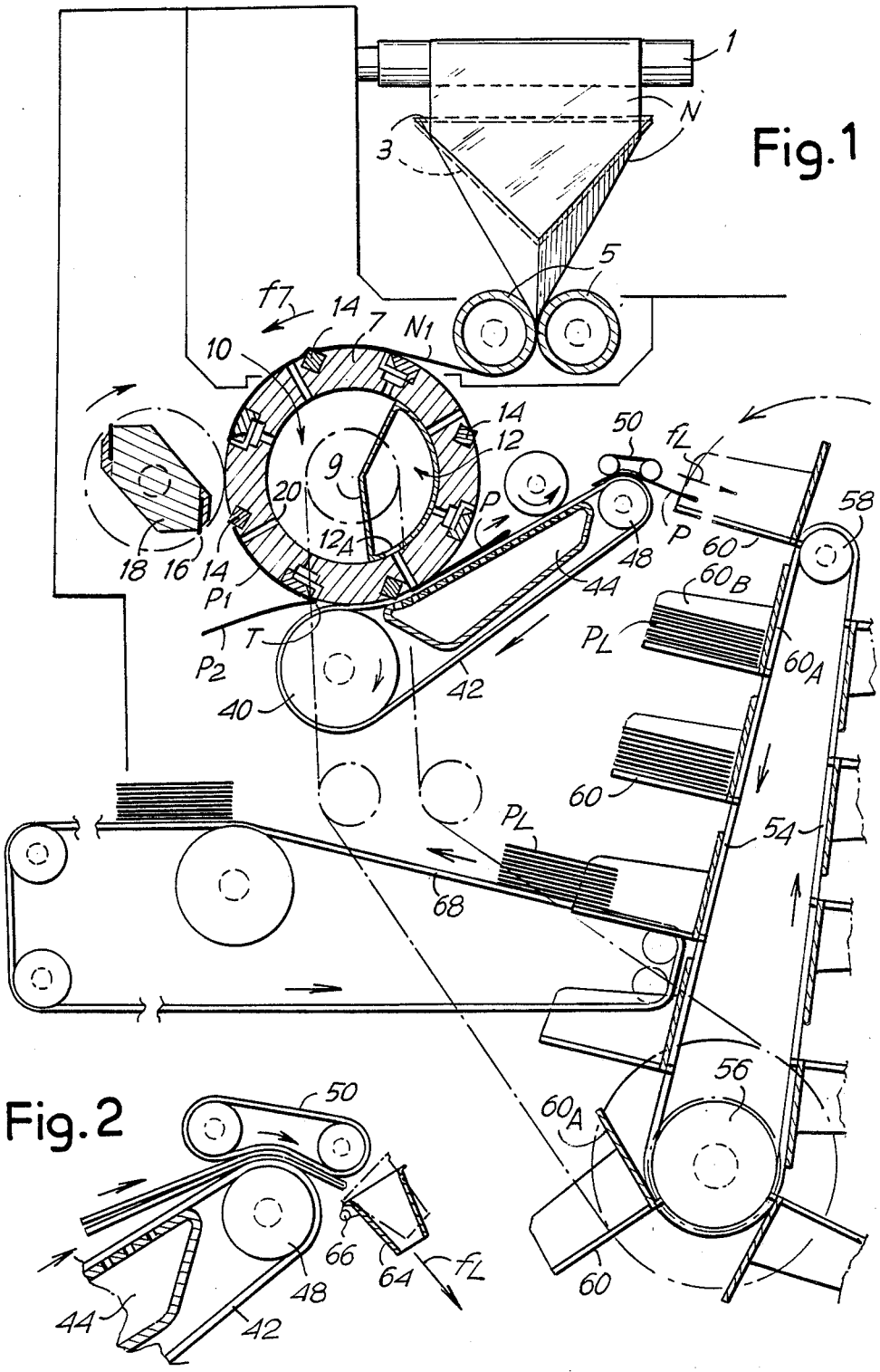
FIG. 1 shows a cross-sectional assembly.
FIG. 2 is a detail of the discharge belt of FIG. 1.

In the embodiment of FIG. 1, the edges of blades 14 and of counterblade(s) 16 are provided along the supporting surface for web N1 on cylinder 7, and a velocity difference may be provided between the cooperating cutting edges of the blade and counterblade. The cutting edges may be parallel to the cylinder axis or at least one of them may be at an angle thereto for a progressive instead of instantaneous cut along the whole transverse length. According to a modified embodiment, the cooperating cutting edges may be located at a radial distance from the axis of cylinder 7 which is greater or less than the radius of the surface of web N1, in order to perform the cut at different velocities.

The blades 14 define, in the example, four surface sections of the cylinder 7, to each of which a length D of web material intended to make up a serviette or other piece under production corresponds.

In each of said sections (four in the example) so defined on cylinder 7, radial passages are provided in the cylinder wall, which are able to cyclically communicate with the vacuum chamber 10 and with an aperture 12A of the high pressure chamber 12. In particular, just in advance of each blade 14 (with respect to the direction of rotation indicated by arrow f7), small holes 20 are provided to ensure, through thevacuum of chamber 10, a retention of the end that is tail portion P1 of the piece that will be produced in that section.

At an intermediate position of each section where it is desired to carry out a transversal folding T of the piece being defined by the transversal cuts of two successive blades, a linear zone of transversal folding T is provided. This linear zone may be, for example, equidistant between two blades 14, or at different distances.

The folding line may be defined (see in particular FIG. 3) by a transversal channel 22, which is formed by a wide recess cut out in the cylinder, with a sectional shape 24 inserted in said recess, and by a block 26 fixed by means of screws 28 in said recess. This block has a plurlity of triangular-shaped slots 30 to create suction openings in one bank of channel 22, as these slots 30 are in communication with chamber 10 through a manifold 32 and holes 34. It is preferred that the openings have a minimum cross-section so as to create the maximum suction effect.

Figure 3:
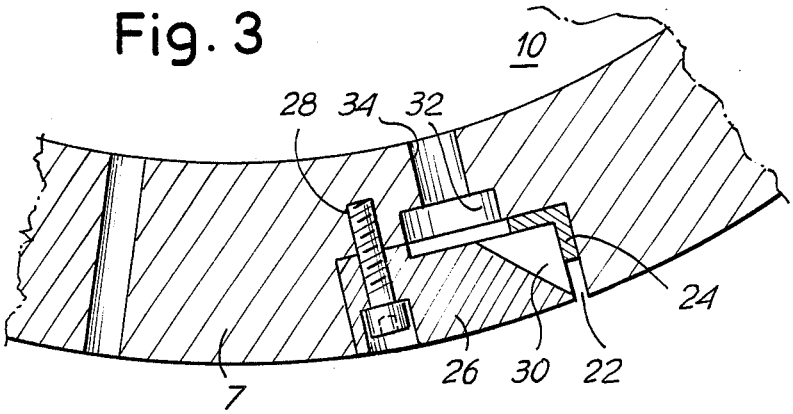
FIGS. 3 and 4 show in detail two modified embodiments of a folding line of cylinder 7 of FIG. 1.
Figure 4:
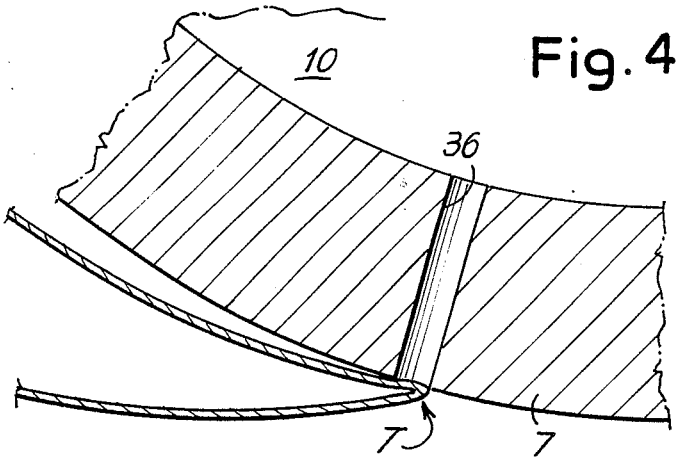

As an alternative to the embodiment of FIG. 3, the folding line T may be defined by a row of radial holes 36 (see FIG. 4) suitable to reach chamber 10 and opening 12A, similar to holes 20 and 34.

Whatever type of linear suction and retention zone for the folding line T may be used, the retention assembly comprising holes 20 and 34 or equivalent, operates as follows. Upon placing the web N1 on the periphery of cylinder 7, the material is kept steady by all the suction-operating retention means made up of holes 20 and channel 22 (or of the row of holes 36 that substitute for said channel), which are in communication with vacuum chamber 10, along the whole angular development of this chamber 10.

After the transit of a blade 14 where the cut takes place (in cooperation with a counterblade 16), the front portion P2 of the web downstream of said blade which has just created the cut, tends to lift away from the surface of the cylinder, both because of centrifugal effect and because this portion "becomes airborne" as a result of the fast movement imposed by cylinder 7 in the direction of arrow f7. Accordingly, P2 tends to lift away from the cylinder and turn backwards. As the rotation proceeds, the whole extension of the front portion P2 of the piece that follows the cut tends to lift off and turn backwards. However, the material is firmly held on cylinder 7 along the folding line T, and the rear portion P1 is also firmly retained as well on the cylinder surface because of the suction provided both along the folding line T and by holes 20 which hold the rear portion P1 of the piece, even after this has been separated from the web by a subsequent cutting by following blade 14 in the cutting zone adjacent the counterblade 16.

In the now defined arrangement, the piece of web N1 is folded back along the transversal line T and in this condition it reaches a pressing roller 40, rotating or driven by cylinder 7, which is arranged to complete the folding along the transversal folding line T and to press the folded piece transversally between the roller 40 and the cylinder 7.

In the embodiment of FIGS. 1 and 2, a continuous belt 42 is supported by roller 40 and is permeable to air and slides along the perforated surface of a vacuum box 44 under the belt 42. The box 44 is under vacuum and, through web 42 and its own peforated surface, exerts a suction and retention action on the folded piece P drawing the portions P1 and P2 close to one another.

Such retention effect begins after the end of vacuum chamber 10 and thus there is not a retention effect by cylinder 7. In fact, as illustrated in FIG. 1, there can be a thrust and release effect caused by the air under pressure in chamber 12 (through the aperture 12A), which is just in alignment with the initial suction zone of the perforated surface of box 44 adjacently and immediately after the pressing roller 40. The air under pressure, blowing through holes 34 or 36 and through holes 20, facilitates the release detachment and themoving away of piece P from the cylinder 7.

The belt 42 may be driven by a roller 48 or by a pair of rollers driving a belt 50 which, operating together with web 42, carries the piece P, just released from the suction effect of vacuum box 44. The two belts 42 and 5 then discharge the pice P in the direction of arrow fL.

As shown in FIG. 1, immediately adjacent the transport roller 48 and belt 50 a collector is disposed to receive the pieces P being folded and discharged in the direction of arrow fL. This collector may comprise a continuous chain-conveyor 54 or similar, driven between wheels 56 and 58, one of which (for example, the one indicated by 56) may be motive and driven in synchronism with cylinder 7 through suitable speed-reducing means and possibly also through means for cyclically varying the speed or causing an intermittent motion of conveyor 54 for the purposes indicated below.

The conveyor 54 carries a plurality of trays 60 spaced apart thereon, which may consist of flat planes 60 (possibly grid or comb-shaped) and having a limit back 60A and possible side members 60B. The folded pieces may be collected in one of trays 60, which is temporarily at a level suitable for the reception in front of the launching zone. After a programmed number of pieces have been collected in one of trays 60, the movement of conveyor 54 causes the positioning of a different and successive tray with a downwards displacement of the tray already filled.

The motion of conveyor 54 may be continuous with adjustable velocity, such to permit the collection of a programmed number of pieces before a new tray takes over in the loading position. For a safe selection of trays, taking into account the high frequency of successive discharges of folded pieces, a timely and cyclic acceleration and a subsequent deceleration of the conveyor may be provided to obtain a rapid positioning of a new tray at the loading position (as far as to provide even an intermittent advancement).

A suitable deviation or steering means 64 may be provided (see FIG. 2) between the launching zone and the trajectory of trays 60. This steering means 64, pivoted at 66, may be cyclically moved between two angular positions, spaced apart to a limited degree, in order to rapidly direct, although to a limited extent, the launch trajectory of pieces so as to rapidly orient such trajectory towards an approaching tray which is about to reach the reception position, and then to move back to a lower position until a new deviation to be carried out. A deviation means like that indicated by 64 or equivalent, having a very limited mass and inertia, is able to ensure a timely orientation for the reception between a tray 60 and the next one.

The stacks PL of pieces (serviettes or other) piled up within the various trays 60, may be carried to a further conveyor 68 which, through suitable comb-like slots in the bottom of trays 60, is able to lift a stack PL of pieces from its tray and move it away for a subsequent handling, in particular, for the packing. It is to be understood that the trays of conveyor 54 may be arranged so as to receive, in advance, a container for the packing of stack PL to be placed therewithin when the tray and container are both in front of trajectory fL. In this case, the packing operation becomes even more simplified and may further be automated.

To carry out an acceleration of the displacement of a tray 60 so as to rapidly pass the launch trajectory fL, instead of relying on cyclic variations of the motion of conveyor 54, it is possible to resort to the speed variation that occurs along the external corners of flat parts of trays 60 during the transit along the driving trajectory around the upper driving wheel 58. In this case, the trajectory fL is intercepted by said external corner of a tray 60 with such a velocity as to ensure a precise numeric selection of pieces piled up within the tray being filled (and within the tray which is about to replace the one already filled) on the basis of predetermined transmission ratios that can be obtained by replacing gears, timing belts, or P.I.V. drives.

According to the modified embodiment shown in FIG. 7, the folded web N1, coming from the pair of rollers 105, reaches a cylinder 107 (similar to cylinder 7) and supplied with blades 114 cooperating with at least a counterblade 116 and a rotor 118. In this example, blades 114 and counterblade(s) 116 cooperate with each other at a position internal to the periphery of cylinder 107, to obtain a differential cutting velocity.

Cylinder 107 may be equipped with passages carrying out a pneumatic vacuum-operated retaining effect and a removal effect by cooperating with vacuum and high pressure chambers like those already described. In this embodiment, the pressing roller 140 (similar to roller 40) acts directly on the folded pieces instead through the interposition of a continuous belt like the one indicated by 42. In this case, the launch according to a trajectory similar to fL, may be carried out directly by cylinder 107 and roller 140. A polished plate 150 may also be provided on which the individual piece, launched and folded with the fold T along the front edge, is caused to slide and is guided in the direction of the arrow fL. A jet of air thrust through an aperture like that indicated with 12A from a high pressure chamber may facilitate the detachment. Plate 150 may be extended upstream with a thin, tapered knife-like edge laid in annular grooves 140A of the pressing roller 140 to prevent squashing of fold T. The absence of squashing is not significant if such grooves 140A are relatively narrow. The edges may be in a limited number but sufficient to facilitate the release of the piece to be launched from pressing roller 140.

FIG. 8 shows a further modified embodiment, according to which each blade 214 of cylinder 207 (similar to cylinder 7) projects from the cylindrical surface and keeps the paper lifted up. The counterblade 216 (similar to that indicated by 16) of unit 218 is retracted (i.e., in back position with respect to the external surface of said unit) and, accordingly, the paper N lifted up by blade 214 moves toward the external surface of unit 218 and can be held by a set of holes 230 which exert a suction on the paper downstream of the cut, that is, on the leading portion of the piece. This causes the lifting of the web from cylinder 207, as the rotation goes on, so as to facilitate the lifting of part P2 and its subsequent overturning. The suction effect is relatively weak, so that part P2 is easily released from holes 230 as this part P2 is drawn by the grip at the folding line.

According to a modified embodiment, not shown, the grip along each folding line T, instead of being pneumatically operated, may be mechanically carried out by a clamping means embedded in the cylinder, such as that indicated by 7 or 107 or 207, and by an external pusher which timely inserts the paper into the clamping means. This is pusher may be carried, for example, by a rotor such as that indicated by 18, or 118, or 218, or by other suitable member. The clamping means will be controlled for the clamping and the release at predetermined angular positions.

It is also to be understood that the present invention includes the possibility of providing diagonal and/or partial folding lines and/or folding lines that can be made partial and formed on the same main cylinder 7 or 107 or 207, or on successive and synchronized cylinders, over which the piece can be made to lie down, in order to obtain successive folds and various special arrangements of the treated piece.

An adjustment of the distance of conveyor 54 from the launch zone may also be provided for varying the sizes of the folded pieces to be received, which pieces in any case are regularly piled up by abutting the back wall 60A of the trays 60 with a minimum of side skid.

Referring now to FIGS. 9 to 14, each paper web N, having the width of a serviette, is driven by a roller 301 towards a triangular folding pan 303 which causes, in a well-known way, the folding of web N along a longitudinal central or at least intermediate folding line or even along several longitudinal folding lines. The so folded web, as indicated for example by N2, reaches a pair of cylinders 305, from which it is driven towards a cutting cylinder 307 intended to provide the advancement and the transversal cut of the web. The cutting cylinder 307 has on its periphery three blade members 309, which are disposed in corresponding cylinder cavities in order to project from the surface of the cylinder.

The three blade members 309 having cutting edges equally spaced from each other.

Between two contiguous blade members 309, at an equidistant position therefrom, a slot 310 is provided so that three slots 310 are actually provided. In the vicinity of each of the blade members 309, a further suction slot 312 may be porvided in a position just ahead, that is, up-stream of the respective blade 309 in the direction of motion as indicated by arrow f307. Each of slots 310 and 312, which are parallel to the cylinder axis, is formed with a cavity 314 in the cylinder wall and with a slat 316 thereby defining the slot 310 (and also 312) through a shaping which may be made up of a set of slots 316A perpendicular to the edges of slat 316, so as to form the slot 310 or 312 in the form of a series of aligned openings. Within each cavity 314, a vacuum may be generated along a portion of the circumferential trajectory described by each of said cavities 314 with the rotation of the cutting cylinder 307 in order to cause a suction effect through the respective slot 310 or 312.

In practice, the suction is developed along an arc A of the trajectory of each cavity 314. To obtain this suction, cylinder 307 is provided (see FIGS. 13 and 14) at least in one end thereof, with a thick disc 318, in which generally triangular passages 320 are formed in alignment with cavities 314. These passages 320 are reduced to radial slots 321, which are open at the outer surface of disc 318. Against disc 318 and at a fixed position in front of cylinder 307 (which rotates together with disc 318) a member 322 is fixed on the supports of same cylinder. Said member has a wide cavity 324 which is kept under vacuum by suitable means, and the cavity also has a slot 326 developing over the width of the above mentioned arc A.

The folded web N2, which reaches tangentially the cylinder 307, is held by the vacuum in the slots 310 and 312 as soon as these are covered up by web N2 driven on cylinder 307. The suction stops at the tangency zone and of minimum interspace between cylinder 307 and a pick-up cylinder 330 which is located close to cylinder 307 and in alignment with the final end of opening 326.

Close to cylinder 307 is also located a second cylinder 332 with blades disposed at an intermediate position along the arc A in which the aspiration opening 326 develops. A further cylinder or roller 334 is disposed close to cylinder 307 between cylinder 332 and the one indicated with 330, for the purposes to be indicated below. Between cylinders 334 and 332 a thinner cylinder (or a polished bar) 335 may be located in spaced-apart relationship with respect to cylinders 332 and 334.

Cylinder 332 has a diameter substantially corresponding to that of cylinder 307, and three blades 336 are mounted thereon at positions equidistant to each other and located so as to project from same cylinder. Each of blades 336 is intended to cooperate with one of said blade members 309 to operate the cutting of web N2 in the tangency zone, that is of the minimum interspace zone between cylinders 307 and 332. Each one of blades 336 rests in a seat formed in the cylinder 332, in which seat the blade is mounted, being held between two thick supports. Numeral 338 indicates a clamping means for the clamping and the adjustment of the relevant blade position. Each one of blades 336 is therefore adjustable in place independently from the other blades to cooperate with blade member 309, that is, the counter-blade 309 with which each blade must cooperate without any need of changing same cooperating counter-blade 309. In this way, a regular cutting operation can be ensured between each blade 336 and each counter-blade 309, which always co-act with one another.

As arrow f332 indicates, the direction of rotation of the blade cylinder 332 (that ensures a concordant motion of blades 336 and counter-blades 309 at the cutting zone), a vacuum slot 340 may be provided just downstream of each of blades 336, which slot is formed in a similar way of each one of slots 310. A cavity 342 causes, similarly to cavity 314, the suction from slot 340, as it comes into communication with a vacuum source through a substantially radial passage 344 formed in a disc (not shown) similar to the situation of the passage 320 of disc 318 already described. Passages 344 cooperate with an opening 346 similar to that indicated by 326 at a fixed position, as illustrated in the drawing, for causing a vacuum and then an aspiration effect through slot 340 when this has passed the zone of minimum distance from cylinder 307 and begins to move away from the surface of this cylinder. The purpose of slots 340 and of their short zone of vacuum activity is to engage the front end of web length N3 which moves forward driven around cylinder 307 in a zone just downstream of the cut created between blade 336 and counter-blade 309 in the vicinity of slot 340.

The aspiration operated through slot 340 engages the leading end of web which has just been cut, and this leading end tends to be moved away from cylinder 307 by slot 340 to become "airborne" and then move farther and farther away from cylinder 307 with the fast rotation of the latter in the direction of arrow f307. The shaping of the opening 346 may be such as to gradually reduce the aspiration and retention effect of the slot 340. The just-cut web, whose leading edge tends to lift away from cylinder 307, is retained, in any case, by the aspiration and vacuum effect operated through slot 310, which has begun to cover the arc A over which this slot is subjected to the vacuum and thus to aspiration.

Hence, the just-cut web becomes "airborne" between the line of cut created by blade 336 and the next suction slot 310, while the web is retained by this slot 310 against the cylinder surface. As a consequence, the portion of web just beyond a cutting line becomes "airborne", that is, leaves the cylinder 307 up to the next slot 310, but it is retained by the latter so that the flap N3 of the "airborne" web is folded along the slot 310 which draws it as far as before cylinder or roller 334. The cylinder or roller 334 causes a pressing of flap N3, which is thus folded more sharply along slot 310 that has retained the web length. The slot 312 retains the rear end of each length of web N2.

The cylinder or bar 335 drags along the lifted flap so as to ease the insertion thereof under cylinder 334. The ribbon-like material N2, longitudinally folded and divided into lengths by successive blades 336, is then folded again in the direction transverse to the already performed longitudinal folding and is thus brought between cylinder 307 and cylinder 330, quarter-folded and still retained by the vacuum from slot 310 and slot 312 as far as the end of arc A (i.e., as far as the zone of minimum distance between cylinders 307 and 330).

Cylinder 330 has a series of circumferential grooves 350, with annular projections formed between contiguous grooves 350. In the annular projections, holes 352 are disposed along three longitudinal rows and communicate with a cavity 354 inside the cylinder 330. Cavity 354 may be limited along an arc C of the circumference, the holes 350 remaining in such case closed along the complementary arc owing to the presence of a fixed wall 356 provided for the closing of said holes 352. Along arc C, which begins a little before the zone of minimum interspace between said cylinder 330 and cylinder 307, holes 350 exert a suction effect and thus a vacuum-operated retention of the cut and folded material, by acting on flap N3 of said material. When the serviette, delimited between two cuts operated by successive blades 336, reaches said zone of minimum distance between cylinders 307 and 330, it is kept thereon by the vacuum of slots 310 and 312, which vacuum stops operating such retention effect at the end of aspiration arc A. The serviette, separated by two successive cuts and folded along slot 310, can be dragged along, in cooperation with the vacuum effect of slot 310, and also by the belts 358 driven between cylinder or roller 334 and the annular grooves 350 of cylinder 330. These belts are made to lie on cylinder 307, in the zone thereof comprised between cylinder or roller 334 and cylinder 330, leaving the surface of cylinder 307 very close to the zone of minimum interspace between this cylinder and cylinder 330. This ensures in any case the advancement of the serviette along cylinder 307 and as far as it is made to lie on cylinder 330, and is retained thereon by the aspiration effect operated through holes 352 of cylinder 330.

It thus follows that as cylinder 330 rotates in the direction of arrow f330 with the same peripheral speed of cylinder 307 and thus of web N2, the serviettes, quarter-folded through the above described operations, are further dragged along cylinder 330 starting from the zone of minimum interspace between cylinders 307 and 330 and over the annular projections between the annular grooves 350, to be piled up afterwards on suitable stacking members in a number desired to make up a package. Further holes 353 may be disposed behind the holes 352 of each row to ensure the adherence of the serviette on the ribs of cylinder 330.

To carry out this stacking, use is made of both cylinder 330 and a further cylinder 360 similar to said cylinder 330 and put side-by-side with the latter at a distance from cylinder 307. Cylinder 360 also has annular grooves 362 similar to those indicated by 350, annular projections between said grooves 362, longitudinal rows of holes 364 similar to those indicated by 352, (in alignment with annular projections comprised between contiguous annular grooves 362) and possible successive holes, similar to those indicated by 353. Holes 364 communicate with a cavity 366 under vacuum located inside cylinder 360 along an arc D delimited by a fixed structure 368 similar to that indicated by 356.

Arc D is substantially developed to a far more limited extent with respect to arc C, that is, between the zone of minimum interspace with cylinder 330 and the lower line of same cylinder 360, while the arc of opening C delimited by structure 356 extends over a longer arc, from the zone of minimum interspace between cylinders 307 and 330 up to the lower line of cylinder 330. Cylinder 360 rotates in the direction of arrow f360 so as to have a motion concordant with cylinder 330 in the zone of minimum interspace between these two cylinders, and with a peripheral speed corresponding to that of cylinder 307 and cylinder 330. As an alternative to the holes located next to those indicated by 352 and 364 (like holes 353), plate guides may be provided extending immediately outside of cylinders 330 and 360; these plate guides may be associated, downstream of the zone of minimum distance between the two cylinders 330 and 360, with a sorting or shunting device to be described below.

In the zone of minimum interspace between the two cylinders 330 and 360, each annular groove 350 being made to correspond to one of annular grooves 362, a sorting or shunting device 370 is located to operate a deviation of the serviette transferred from cylinder 307 to cylinder 330 after this erviette has covered the trajectory between the zone of minimum interspace between cylinders 330 and 307 and the zone of minimum interspace between cylinders 330 and 360.

It should be noted that the serviettes on cylinder 307 and on cylinder 330 being folded, are spaced apart from each other, and thus the sorting device 370 alternatively allows the incoming serviettes either to continue their trajectory with cylinder 330 or to be transferred on cylinder 360.

The sorting device 370 operates a commutation of the operation whenever a predetermined number of serviettes has passed, for example, after the passage of thirty serviettes, to form packs made up of a corresponding number of serviettes below cylinder 330 and, successively, below cylinder 360 and vice versa. The packs of serviettes formed below cylinder 330 may have a number of serviettes equal to or different from that of packs formed below cylinder 360. The sorting device 370 is mounted so as to oscillate on a shaft 372 parallel to the axes of cylinders 330 and 360, and has a plurality of fingers 374 shaped in correspondence of the annular grooves 350 and 362. In the position illustrated in FIG. 11 of the drawing, the ends of fingers 374 are within grooves 362 and, therefore, these fingers facilitate the displacement of the serviettes dragged along by the vacuum through holes 352, as they follow the cylinder 330 up to the lower part thereof.

In said lower part of cylinder 330, within grooves 350, prongs 376 of a comb 378 extend, which comb is able to vibrate (that is, oscillate) together with the shaft 380 on which it is mounted. When the sorting device 370 is moved from the right to the left position (looking at FIG. 11 of the drawing) and thus within grooves 350, the serviettes dragged along by cylinder 330 are urged to deflect on the surface of cylinder 360 and thus be vacuum-seized by holes 364 to be drawn in the direction of arrow f360 as far as the lower part of cyliner 360 where they meet prongs 382 of a comb 384 able to oscillate about its supporting shaft 386.

It should be noted that the rows of holes 352, 364 are disposed on cylinders 330 and 360 so as to correspond to each other in the zone of minimum distance between the two cylinders 330 and 360. Moreover, the rows of holes 352 reach the zone of minimum interspace between cylinders 307 and 330 almost simultaneously to slots 310. Combs 376 and 382 are moved downwards from the position inside the grooves 350 and 362 a the same frequency with which the serviettes can arrive on the respective cylinders (dragged along by the vacuum operated via holes 352 and 364). The phasing is such that the comb pulls off the serviette and launches it by inertia into a corresponding tray wherein a set of serviettes TO coming from the respective cylinder 330 or 360 is collected in a number corresponding to the predetermined one for which the sorting device was adjusted. Holes 352 may be closed off by wall 356, in the lower zone of cylinder 330. The contiguous holes 353 may be suitably closed in advance through, for example, a suitable disalignment thereof with respect to holes 352 and a toothed shaping of the active edge of wall 356. However, it is understood that the serviettes removal may be carried out by combs 376 and 382, or may be facilitated by the same combs.

Adjacent to and below each one of cylinders 330 and 360 a device is provided for the collection and removal of packs of serviettes TO. Only one of devices 390 and 392, predisposed below cylinders 330 and 360, respectively, is described, the other being symmetrical apart from its possible capability of receiving a different number of serviettes for the formation of each pack.

Device 390 includes a pair of chains 394 and another pair of chains 396, disposed so as to be driven by pulleys 398 and 400 along a rectangular path. To chains 394 and 396, trays 406 are connected at 402 and 404, forming a cantilever comb-like collecting grid 408, located below cylinder 330 and thus below the mobile, shaped-end parts of prongs 376 of comb 378. The collecting grid 408 moves horizontally or inclined upwards and towards cylinder 360, and may be made to vibrate. The grid 408 extends beyond a fixed retaining wall 410 set at right angles thereto and disposed side-by-side to a belt conveyor 412 whose upper, active portion is approximately at the same level of the lower portions of chains 394 and 396 and which may be at least partially inclined.

When a serviette reaches the lower zone of the cylinder 330, it is released therefrom owing to the timely-operated downwards displacement of prongs 376 of the comb oscillating together with shaft 380. As a consequence, the individual serviettes become piled up at T0 on the comb-like grid 408 with the front fold of serviettes resting on and abutting against the upper part of wall 410, thereby aligning the serviettes of pack T0. The serviette are pressed down each time by prongs 376, and it should be noted that these prongs may be moved at the same arrival high frequency of the incoming serviettes, owing to the small displacement angle required for these prongs, the pack of serviettes T0 being formed lying just below cylinder 330.

Chains 394 and 396 are moved, upon the stacking phase of serviettes in the pack T0, with a very low speed to allow a small lowering of the comb-like grid 408 (for example of 1 or 1.5 mm) at the arrival of each serviette, with a motion which is mostly a continuous motion. Once the desired number of serviettes piled up in pack T0 has been reached, the sorting device 370 is changed over to begin the accumulation of serviettes below the other cylinder 360, during the formation of which, chains 394 and 396 of device 390 are driven to complete a shifting cycle of the articulation points 402 and 404. Therefore, the pack of serviettes T0 formed on the grid 408 is deposited on the upper active portion of conveyor 412 and the comb-like grid 408 is slipped out below the pack of serviettes T0 owing to the shift of articulations 402 and 404 along the lower portions of chains 394 and 396, the serviettes being held back by the vertical wall 410.

Conveyor 412 is able to advance with a continuous or step-by-step motion, and the displacement cycle of chains 394 and 396 is completed by the new arrangement of the comb-like grid 408 reaching, just below cylinder 330, the lifted position in which the piling up of serviettes of a further pack begins. All this movement can be carried out during the time in which a desired number of serviettes for the formation of a pack is piled up under the other cylinder 360. The operation of device 392 is like that of device 390 and is half-cycle out of phase therewith.

The collection of packs of serviettes may be carried out after a packaging of same packs in order to achieve an easy handling. The packs can be suitably lowered with respect to cylinder 330 (and 360) and can be moved away also in directions other than those of the illustrated conveyors, such as the one indicated by 412.

The apparatus can operate on a plurality of feeding webs N, formed, for example, from a larger web N0 (see FIGS. 15 and 16) with several triangular folding pans 1303 being offset and combined with pairs of converging rollers 1306 which cause the respective web N2 (longitudinally folded) to move to a pair of rollers 305 (like that already described). The individual webs N2, longitudinally folded, will be fed, spaced apart from each other to meet various requirements.

The conveyors 412 may be associated with or replaced by other suitable devices for the removal of packs of serviettes.

It is furthermore to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to protect by Letters Patent are the following:

1. An apparatus for the production of paper webs and particularly paper table napkins, including means for folding the paper one or more times, said means including:

a cylinder for the advancement of the web and for performing a transversal cut, and means for continuously feeding the web to said cylinder, cutting means on said cylinder, and retaining means disposed at a distance from said cutting means, and in juxtaposition thereto along a line where a fold is to be carried out so as to obtain, through the rapid advancement of said cylinder, a lifting and reverse turning of the paper in advance of said line, a rotor carrying a plurality of blades disposed in cooperative arrangement with a cutting means on said cylinder, and a pressing roller acting against said cylinder to complete the folding, and means for interrupting and retaining said web along said folding line after the folding line has passed the pressing roller, and means to remove the folded web away from said cylinder, the pressing roller (40) being associated with a continuous conveyer (42) cooperating with a sucking case (44), to move the pieces pressed and pulled off from the cylinder.

2. Apparatus according to claim 1 characterized in that the means for removing the folded pieces comprise a plurality of seats (60, 60A, 60B) on a continuous conveyer (54), which cause same seats to transit in front of the launching trajectory, in order to collect. within each seat, a predetermined number of pieces (P) which are picked up for the packing.

3. Apparatus according to claim 2, characterized in that an acceleration of seats (60, 60A, 60B) in front of the launch trajectory is obtained by exploiting the greater velocity imposed to the external edge of the flat portion of the seat upon the transit along a driving wheel (58) of the conveyer (50) which carries said seats.

4. Apparatus according to claim 2 characterized in that the conveyer (54) of the collecting seats is driven with adjustable velocity in order to vary the number of pieces collected within each seat.

5. Apparatus according to claim 2, characterized in that, within each of said seats, an element useful to the packing may be predisposed.

6. Apparatus according to claim 2 characterized in that it comprises, in the launch trajectory, a deviation means (64) to facilitate the distribution of pieces from one seat to the next seat.

7. Apparatus according to claim 2 characterized in that the continuous conveyer (54) is adjustable with its own seats at positions relative to the launch trajectory, both in height and distance.

8. Apparatus according to claim 2 claims, characterized in that the launching of the folded piece is performed in cooperation with the cutting cylinder (107) and the pressing roller (140).

9. Apparatus according to claim 8, characterized, externally of the cutting cylinder (7; 107; 207; 307) by suction retaining means (230; 340) for the initial portion of the folded piece which ease the pulling off and the overturning of said portion, up to the folding line.

10. Apparatus according to claim 9, characterized in that said external retention means (230; 340) are carried by the rotor (218; 332) of the counterblades; the blades of the cylinder being made advantageously to project and the counterblades being embedded in order to lift the paper from the cylinder and move it close to said external retention means.

11. Apparatus according to claim 10, characterized in that the folding lines are provided inclined and such as to be made partial in order to carry out successive foldings.

12. Apparatus for the production of serviettes or similar paper articles folded one or more times, including:

means for continuously feeding the web, and a cutting cylinder for advancement of the web, said cutting cylinder including means for providing transverse cuts in cooperation with blades on a blade-cylinder, and a blade-cylinder with one or more blades to cooperate with the aforesaid cutting cylinder, and retaining means on said cutting cylinder to provide a transversal fold by the rapid advancement of the cutting cylinder so as to provide a lifting and reverse turning along the folding line of a portion of the web in advance of said line, and a pressing roller acting in cooperation with said cylinder to complete the folding, and means for interrupting and retaining the web along said folding line after it has passed the pressing roller, and a rotating pick-up cylinder with at least one row of suction holes and a vacuum within said cylinder so as to suck the folded piece between the cutting cylinder and the pick-up roll in the zone of the minimum interspace between the cutting cylinder and the pick-up cylinder, and an additional cylinder similar to, and located in close proximity to, the pick-up cylinder with a plurality of holes along at least one suction line, and shunting mechanism with movable plates between said pick-up cylinder and said additional cylinder which move the individual pieces from the zone of minimum interspace and move them in a continuous trajectory along the pick-up cylinder or, alternatively, the additional cylinder, and means for moving cut pieces from the apparatus and stacking them adjacent the pick-up cylinder and said additional cylinder.

13. Apparatus according to claim 12, characterized in that said means for moving the picked up pieces away from the pick up cylinder (330) and piling them up comprise: on said pick up cylinder (330) circumferential grooves (350) separated by projections in which said holes (352) of the aspiration line lead; and comb-like means (376, 378, 380) with prongs (376) within the grooves (350) for moving away the pieces arrived along said pick up cylinder.

14. Apparatus according to claim 13, characterized in that the comb-like means (376, 378, 380) vibrate in synchronism with the advancement of the pieces on the pick up cylinder (330) in order to arrange the pieces on a collecting device (390) in a pile of pieces (T0) being formed.

15. Apparatus according to claim 12, characterized in that it comprises on said cylinder (330, 360), means such as holes (353) and/or plates, for the retention of pieces moving forward and dragged along by holes (352, 364) of rows of suction holes on said cylinders (330, 360).

16. Apparatus according to claim 12, characterized in that said means (390, 392) for the accumulation of pieces—such as the serviettes—comprise: a collecting grid (408) that can be gradually lowered from the respective grooved cylinder (330; 360); a fixed retaining grid (410), orthogonal to and interfering with said collecting grid (408), in order to make up a resting and retaining abutment for the pieces piling up on said collecting grid (408); a conveyer (412) for receiving the piles of pieces formed on said collecting grid (408); and a chain drive (394, 400) or similar for cyclically moving said collecting grid (408) by slipping it out from the retaining grid (410) at the end of the lowering trajectory, lifting and reinserting it below the grooved cylinder (330).

17. Apparatus according to claim 12, characterized by a cylinder or roller (334) brought close to the blade cylinder (330) to carry out the transversal folding of the cut piece, a cylinder or roller (334), and a set of belts (358), which are driven within the circumferential grooves (350) of the pick up cylinder (330), to drag along the folded piece.

18. Apparatus according to claim 12, characterized by a roller or bar (335) for guiding the lifted front flap of the cut piece, and drawing it against the cutting cylinder (307).

19. Apparatus according to claim 1, characterized in that said retaining means (22; 36; 310) are of pneumatic type.

20. Apparatus according to claim 1, characterized in that said retaining means are of mechanical type.

21. Apparatus according to claim 1, characterized in that said folding line (T) is transversal and the piece is moved away by being launched along a trajectory with the fold onwards.

22. Apparatus according to claim 1, characterized in that it comprises, on said cutting cylinder (7; 107; 207; 307), suction-operated retaining means (20; 312) to retain the paper portion at the back of the transversal folding line until the folded piece is moved away.

23. Apparatus according to claim 1 characterized in that it comprises, on the cutting cylinder (7; 107) means (12; 12A) for generating a blowing by internal overpressure via passages (22; 20) through which the suction for the retention along the folding line and/or in the zone at the back of the folding line has been exerted.

24. Apparatus according to claim 22 characterized in that, along the folding line (T), the suction operated retaining means consist of a row of holes (22; 30; 34; 36; 310) able to communicate with a suction fixed cavity.

25. Apparatus according to claim 22 characterized in that, along the folding line, the suction operated retaining means include a channel ((22; 310) with holes leading in correspondence of a bank thereof.

26. Apparatus according to claim 1 characterized in that the blade of the blade-cylinder and the blade of the cutting cylinder are located at the side of said cylinder and arranged so that the cutting edges thereof travel in a circle having a diameter different from the diameter of the said cylinder, whereby the blades have different velocities.

* * * * *